US007001193B2

(12) United States Patent
Zaderej et al.

(10) Patent No.: US 7,001,193 B2
(45) Date of Patent: Feb. 21, 2006

(54) HINGE CONNECTOR FOR ELECTRONIC DEVICE

(75) Inventors: Victor Zaderej, St. Charles, IL (US); Kevin Delaney, Ennis (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/722,799

(22) Filed: Nov. 26, 2003

(65) Prior Publication Data

US 2005/0112909 A1 May 26, 2005

(51) Int. Cl.
*H01R 3/00* (2006.01)

(52) U.S. Cl. ..... 439/165

(58) Field of Classification Search ..... 439/11, 439/13, 31, 165, 12; 361/681
See application file for complete search history.

(56) References Cited

U.S. PATENT DOCUMENTS 5,237,488 A * 8/1993 Moser et al. ..... 361/681
5,927,997 A * 7/1999 Ruland et al. ..... 439/31

* cited by examiner

*Primary Examiner*—Phuong Dinh
(74) *Attorney, Agent, or Firm*—Robert J. Zeitler

(57) ABSTRACT

A hinge for an electronic device includes a body and a contact member. The body includes a printed circuit board and a plurality of terminals extending therefrom. The contact member includes a plurality of contacts defining a contact passageway. The body is partially positioned within the contact passageway such that an electrical connection is provided between the terminals of the body and the contacts of the contact member. The contact member rotates relative to the body and electrical contact is maintained between the terminals and the contacts throughout this rotation.

14 Claims, 5 Drawing Sheets

HINGE CONNECTOR FOR ELECTRONIC DEVICE

BACKGROUND OF THE INVENTION

Electronic devices, such as notebook computers, personal digital assistants (PDAs), cellular telephones, portable compact disc (CD) players and the like, are often designed with flip-up covers which are connected to a base through a hinge. Electronic components are provided in the base of the device and in the cover of the device. These electronic components must be electrically connected through a hinged interface.

Prior art electronic devices interconnect the electronic components in the base of the device and the cover of the device by flexible circuits that are routed through the hinge and mated to the printed wiring boards (PWBs) or displays in the base or cover. These flex circuits are expensive, are difficult to install in the hinge, require manual labor, and have reliability issues. The hinge and the interconnect therethrough have one of the highest reliability problems for these types of electronic devices.

Often, if the hinge and/or the flex circuit fails, the entire device is disposed of instead of replacing the damaged components. As color, as well as other features, such as cameras, are being used in more electronic devices, the replacement of the entire electronic device is not cost effective.

The present invention provides a hinge and interconnect which provides a solution to these problems. Other features and advantages will become apparent upon reading the attached specification in combination with a study of the drawings.

OBJECTS AND SUMMARY OF THE INVENTION

A general object of the present invention is to provide a hinge for an electronic device which is reliable in use.

An object of the present invention is to provide a hinge which can be easily replaced if damaged.

Another object of the present invention is to provide a hinge which can easily be made longer or shorter as desired.

A further object of the present invention to provide a hinge which can be easily manufactured.

A specific object of the present invention is to provide a hinge which provides electrical shielding.

Briefly, and in accordance with the foregoing, the present invention discloses a hinge which includes terminals mounted to a printed circuit board, positioned within a contact, and mated with the contact. As the contact is rotated relative to the terminal, electrical contact is maintained between the contact and the terminal.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT(S)

Figure 1:
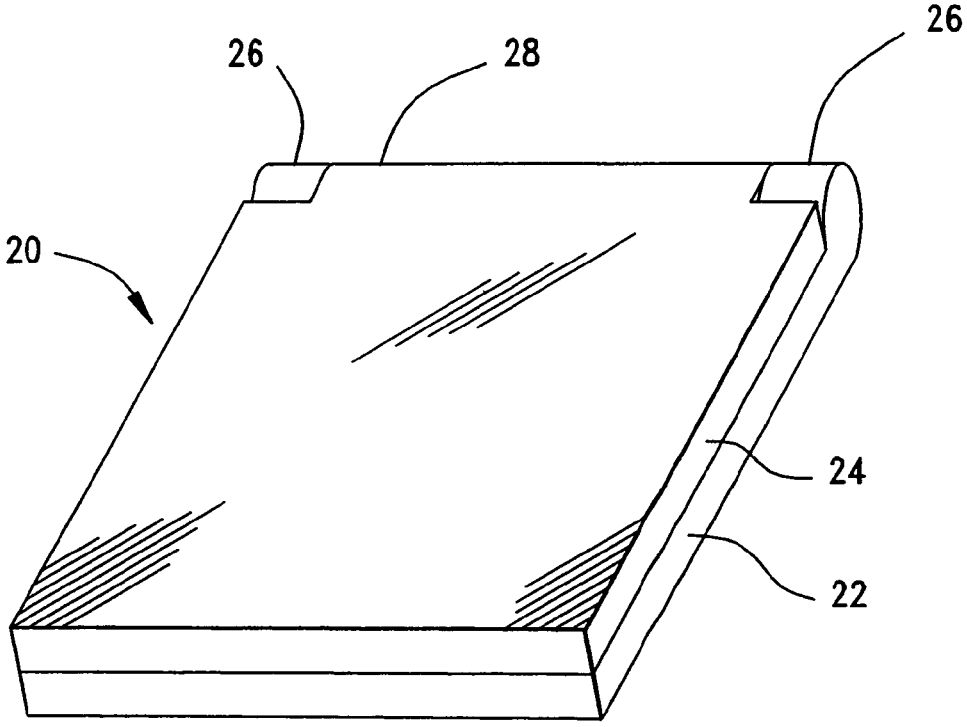
FIG. 1 is a perspective view of an electronic device in which the hinge of the present invention is used.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 7:
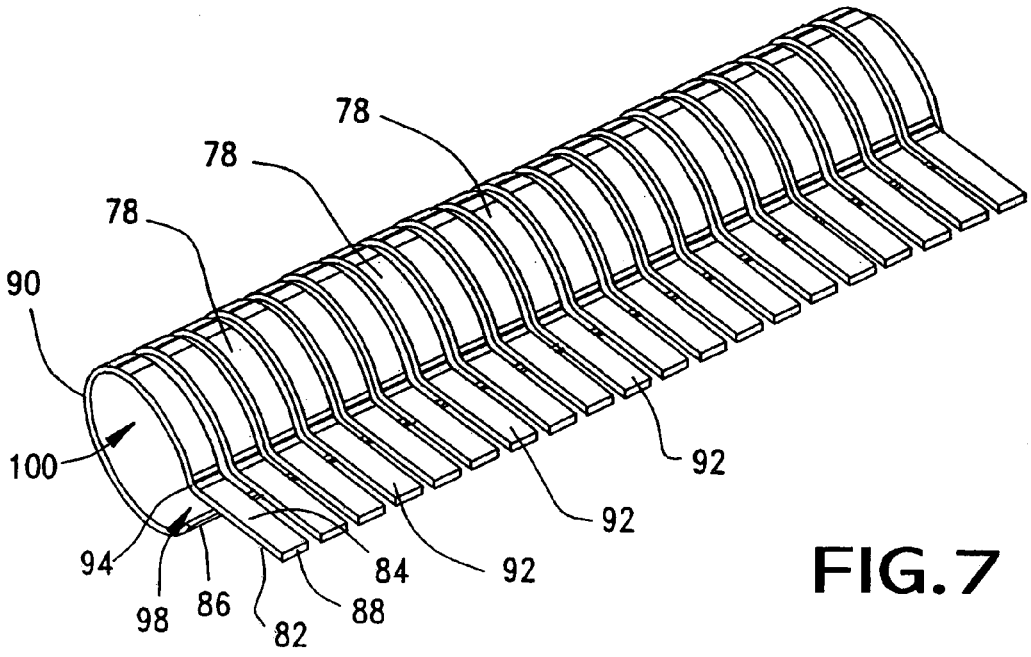
FIG. 7 is a perspective view of a contact of the hinge of FIG. 2.
Figure 8:
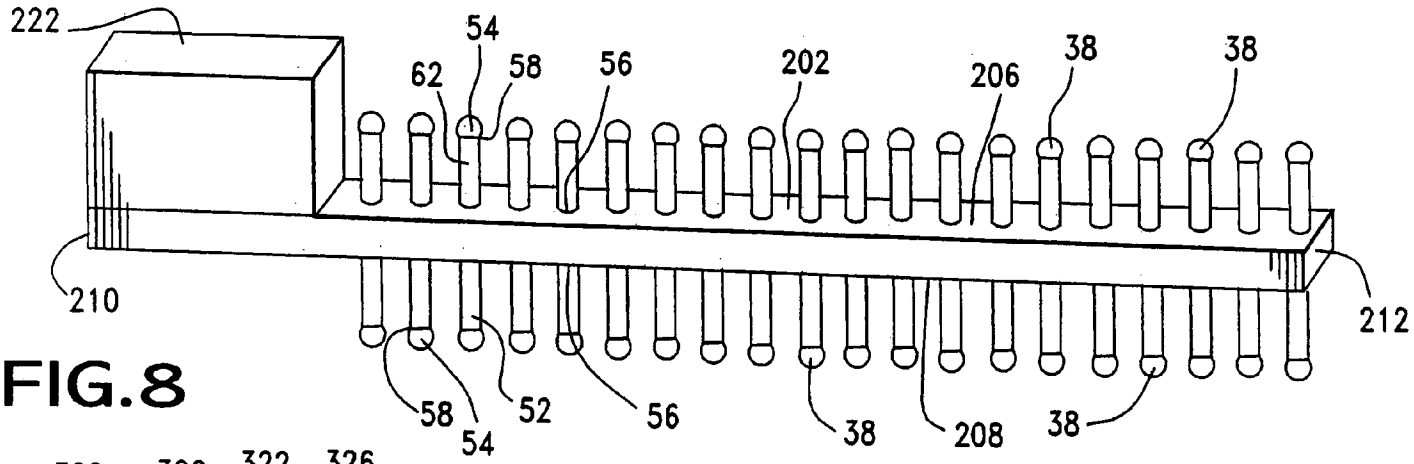
FIG. 8 is a perspective view of a portion of a hinge which incorporates features of a second embodiment of the present invention.
Figure 9:
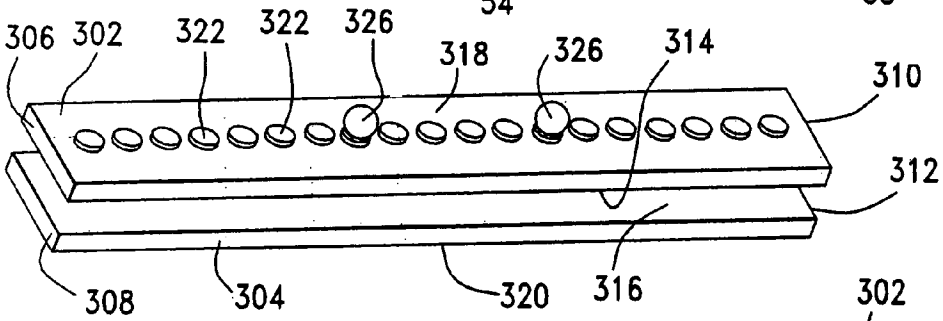
FIG. 9 is a perspective view of a portion of a hinge which incorporates features of the third embodiment of the present invention.
Figure 10:
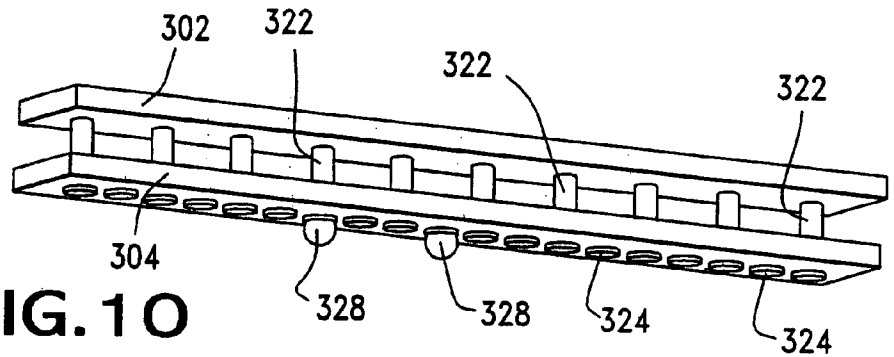
FIG. 10 is a perspective view of a portion of a hinge which incorporates features of a third embodiment of the present invention.

The hinge of the present invention is used in an electronic device 20, such as a notebook computer, a personal digital assistant (PDA) a cellular telephone, a portable compact disc (CD) player and the like. As shown in FIG. 1, the electronic device 20 includes a base 22 and a flip-up cover 24 each including electronic components. The cover 24 is rotatable relative to the base 22 and connected thereto through interconnecting components 26. A hinge receiving space 28 is provided to house the hinge 30 of the present invention which electrically connects the electronic components in the base 22 to the electronic components in the cover 24. A first embodiment of the hinge 30 of the present invention is shown in FIGS. 2–7, a second embodiment of the hinge is shown in FIG. 8, and a third embodiment of the hinge is shown in FIGS. 9–10.

Figure 2:
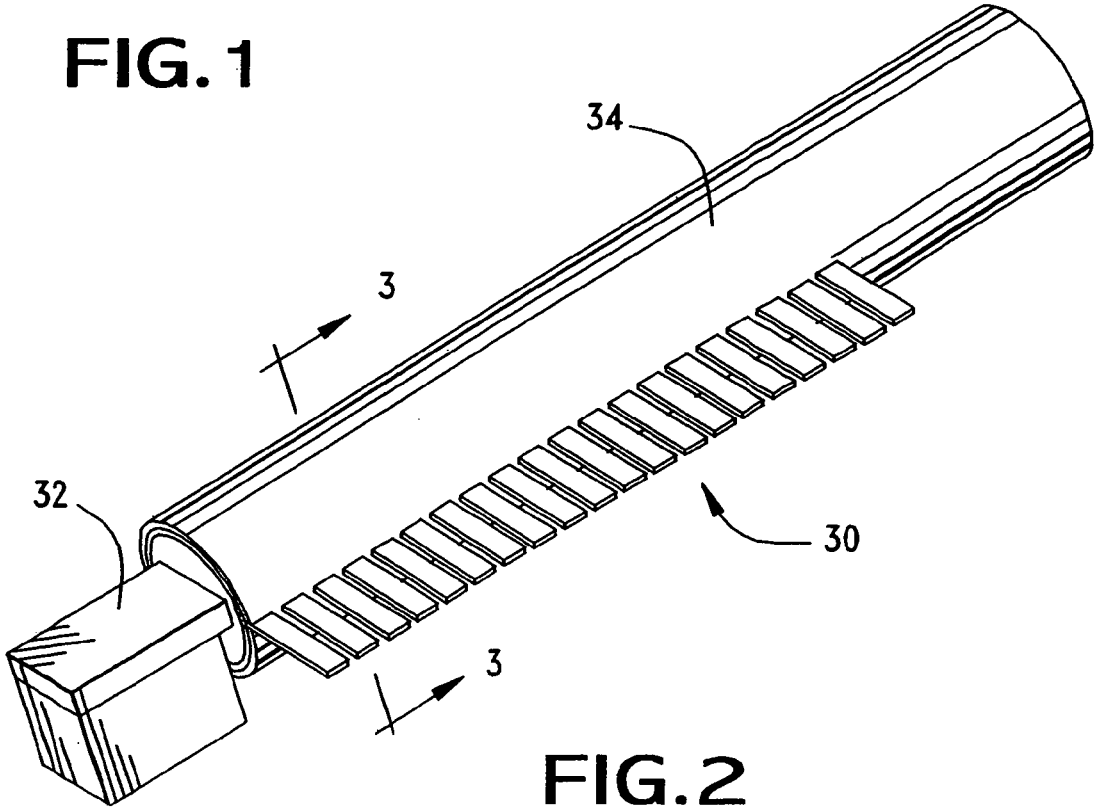
FIG. 2 is a perspective view of a hinge which incorporates features of a first embodiment of the present invention.
Figure 3:
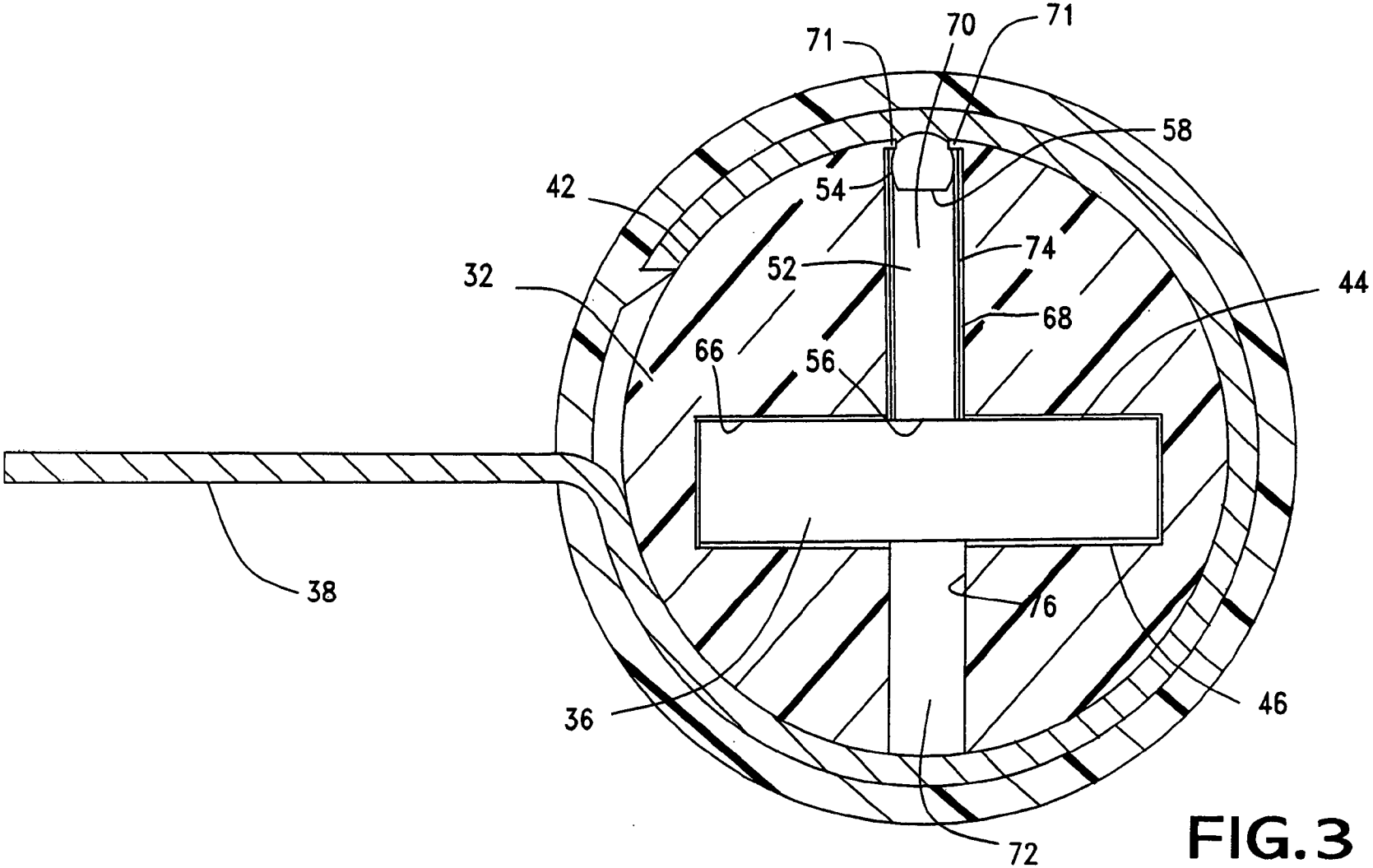
FIG. 3 is a cross sectional view of the hinge of FIG. 2 taken along line 3—3.

Attention is invited to the first embodiment of the hinge 30 shown in FIGS. 2–7. As shown in FIGS. 2 and 3, the hinge 30 generally includes a body 32 and a contact member 34. The body 32 is partially positioned within the contact member 34 and partially extends from the contact member 34.

Figure 4A:
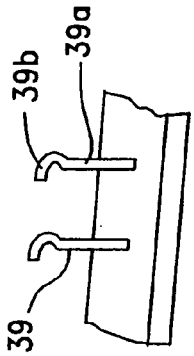
FIG. 4*a* is a perspective view of an alternative terminal used in connection with the hinge of FIG. 2.
Figure 4:
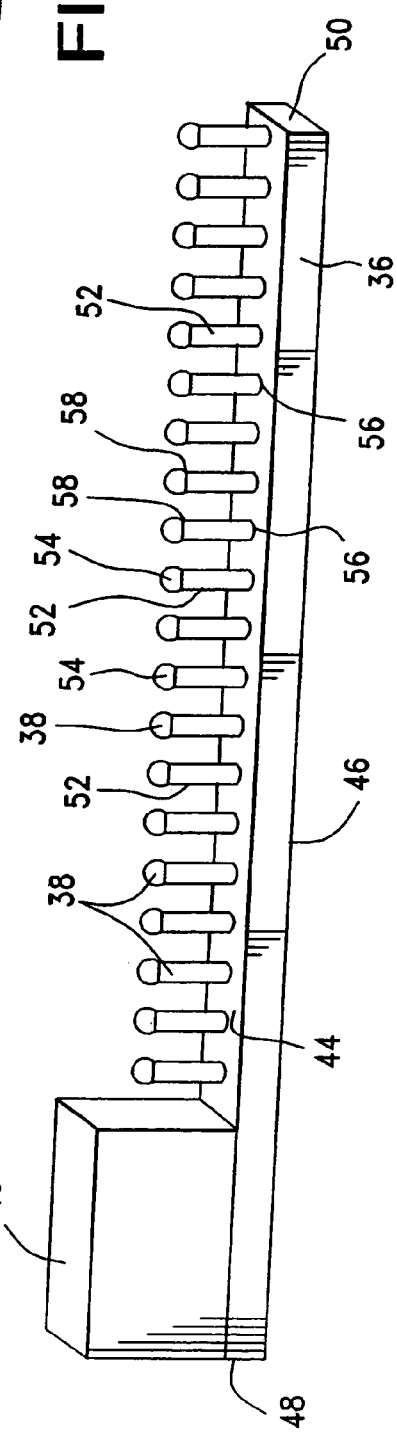
FIG. 4 is a perspective view of a portion of the hinge of FIG. 2.

As best shown in FIG. 3, the body 32 includes a rectangularly-shaped printed circuit board 36, a plurality of spaced apart conductive terminals 38 extending from the printed circuit board 36, and a connector 40 extending from the printed circuit board 36. As best shown in FIG. 4, the body 32 also includes a generally cylindrically-shaped terminal sleeve 42.

The printed circuit board 36 has a first surface 44, a second surface 46, a proximal end 48 and a distal end 50. The terminals 38 extend perpendicularly from first surface 44 of the printed circuit board 36. Each terminal 38 includes a spring 52 and a ball 54. Each spring has opposite first 56 and second 58 ends. The first end 56 of each spring 52 is attached to the first surface 44 of the printed circuit board 36.

A ball 54 is attached to the second end 58 of each spring 52. Alternatively, rather than using a spring 52 and a ball 54, the terminals 38 could be stamped metal. A stamped metal contact 39 is shown in FIG. 4*a*. The stamped metal contact 39 includes a base 39*a* and a curved arm 39*b* extending from the base 39*a*. The arm 39*b* is capable of flexing relative to the base 39*a*. As shown in FIG. 4, the connector 40, such as, for example, a telephone connector, is also attached to the first surface 44 of the printed circuit board 36 proximate the proximal end 48 thereof.

Figure 5:
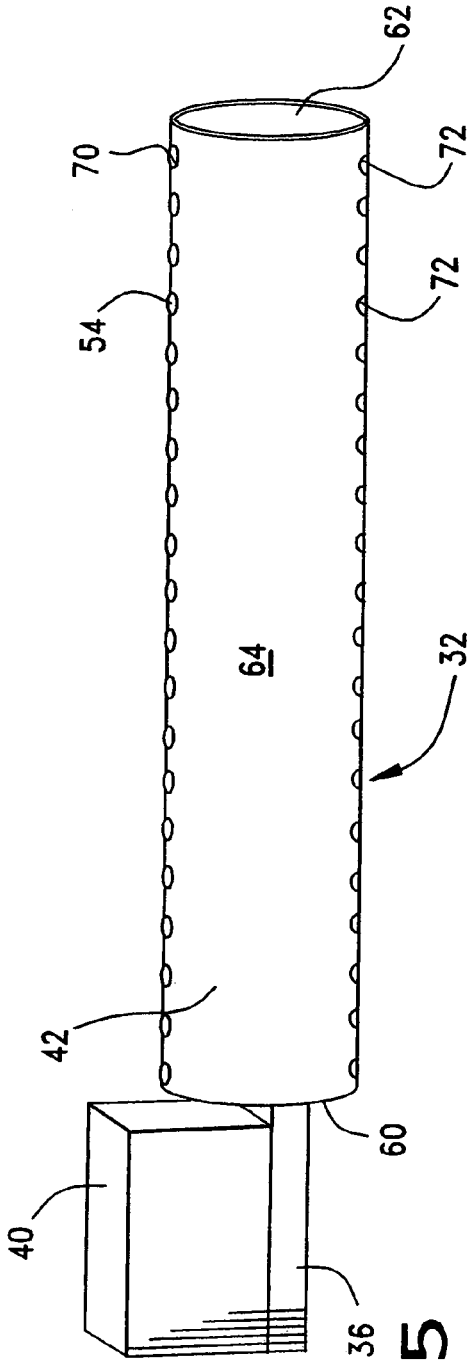
FIG. 5 is a perspective view of a body of the hinge of FIG. 2.

The generally cylindrically-shaped terminal sleeve 42 is best shown in FIGS. 3 and 5. The terminal sleeve 42 is formed from a dielectric material and has a proximal end 60, a distal end 62, and an outer surface 64. A generally elongated rectangularly shaped printed circuit board passageway 66, see FIG. 3, forms and inner surface and extends from the proximal end 60 to the distal end 62 of the sleeve 42. A plurality of terminal passageways 68 are provided across the diameter of the terminal sleeve 42 such that a pair of diametrically opposed terminal passageway openings 70, 72 are provided through the outer surface 64 of the terminal sleeve 42 in connection with each terminal passageway 68. Fingers 71 extend inwardly from the circumference of each opening 70 to reduce the effective diameter of each opening 70 for reasons described herein. The terminal passageways 68 are generally cylindrically-shaped and are in communication with the printed circuit board passageway 66. A first portion 74 of each terminal passageway 68 extends from the printed circuit board passageway 66 to the opening 70. A second portion 76 of the each terminal passageway 68 extends from the printed circuit board passageway 66 to the opening 72, diametrically opposed to the opening 70.

The printed circuit board 36 and the terminals 38 are positioned within the terminal sleeve 42 such that the printed circuit board 36 is positioned within the printed circuit board passageway 66 and each terminal 38 is positioned within the first portion 74 of a terminal passageway 68 and each ball 54 associated with each terminal 38 extends partially through each opening 70. The proximal end 48 of the printed circuit board 36 extends from the terminal sleeve 42 such that the connector 40 is not positioned within the terminal sleeve 42.

Figure 6:
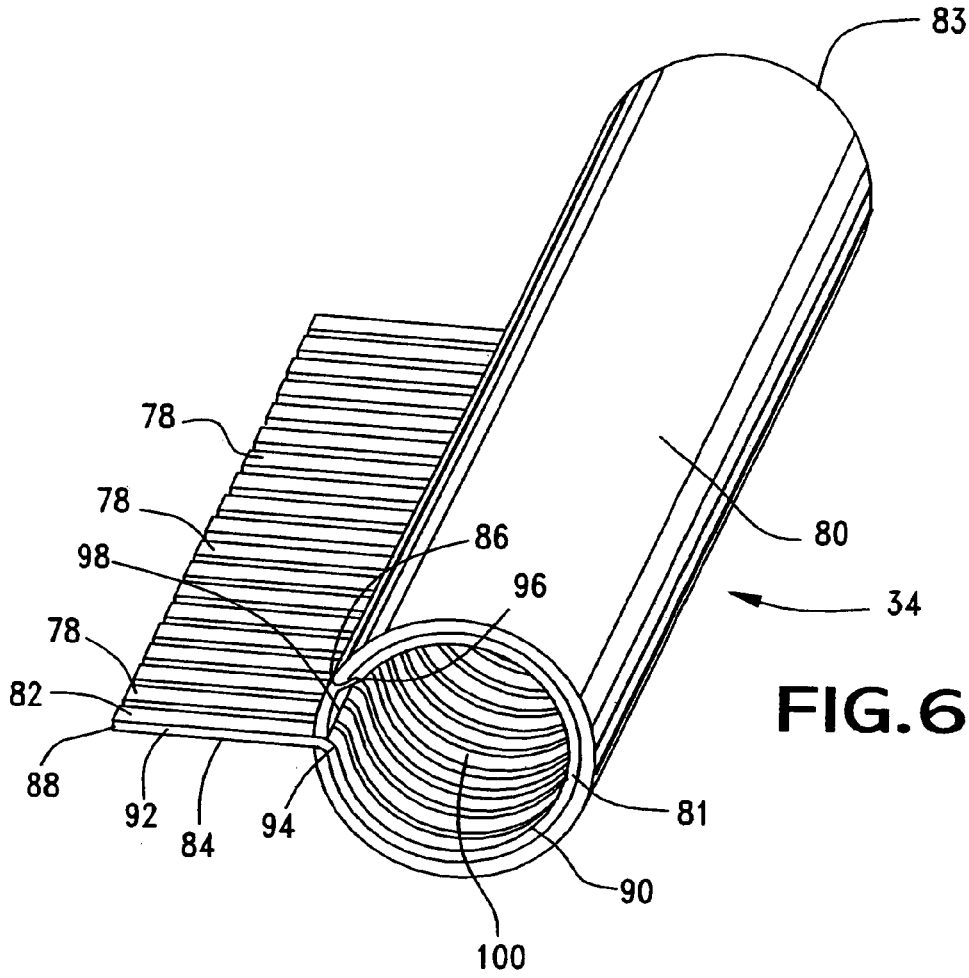
FIG. 6 is a perspective view of a contact member of the hinge of FIG. 2.

As best shown in FIG. 6, the contact member 34 includes a plurality of spaced apart contacts 78 partially within a contact sleeve 80. As shown in FIG. 7, each contact 78 is formed from a generally elongated rectangularly shaped piece having a first surface 82, a second surface 84, a first end 86 and a second end 88. Each contact 78 includes a circular portion 90 and a tail portion 92. The portion extending from the first end 86 forms the circular portion 90 and the portion extending from the second end 88 forms the tail portion 92. An elbow 94 is provided where the circular portion 90 and the tail portion 92 meet. A detent 96 extends from the first surface 82 of each contact 78 proximate the first end 86 for reasons described herein. The first end 86 is spaced from the elbow 94 such that a gap 98 is provided between the first end 86 and the elbow 94. The contacts 78 are similarly aligned and positioned proximate one another such that a contact passageway 100 is defined by the contacts 78. The diameter of the contact passageway 100 is slightly larger than the outer diameter of the terminal sleeve 42. The contacts 78 are formed from conductive material, such as metal.

The contact sleeve 80 is generally tubularly-shaped and has a proximal end 81 and a distal end 83. The contact sleeve 80 is provided around the circular portions 90 of the contacts 78. The tails 92 of the contacts 78 extend from the contact sleeve 80. Preferably, the contact sleeve 80 is formed by insert molding plastic over the contacts 78. Preferably, the contact sleeve 80 is molded such that the first surface 82 of the circular portion 90 of each contact 78 is flush with the inner surface 80*a* of the contact sleeve 80. Alternatively, the sleeve 80 could be molded such that the contact 78 extends inwardly from the inner surface 80*a* of the contact sleeve 80. In the event the sleeve 80 is molded such that the first surface 82 of each contact 78 extends from the inner surface 80*a* of the contact sleeve 80, inwardly projecting ribs will be provided between each contact 78. Upon assembly and use of the hinge 30 as will be described herein, these inwardly projecting ribs will act as guides for the balls 54. Alternatively, the contact sleeve 80 could be molded such that the inner surface 80*a* of the contact sleeve extends from the first surfaces 82 of the contacts 78. Thus, grooves would be provided between each contact 78.

In those instances where shielding is required, such as where high-speed signals are being transmitted, the contact sleeve 80 can include shielding 87. Preferably, the shielding 87 will be on the outer surface of the contact sleeve 80. The shielding 87 can take the form of metal placed around the outer surface of the contact sleeve 80, or could also be in the form of plating on the outer surface of the contact sleeve. Alternatively, the shielding 87 can be internal to the contact sleeve 80.

The body 32 of the hinge 30 is assembled prior to assembly of the body 32 with the contact member 34. To assemble the body 32, the user begins by orientating the terminal sleeve 42 such that the openings 72 face upward. The assembler then drops a ball 54 through each opening 72. The balls 54 pass through the openings 72, through the second portion 76 of the terminal passageway 68, passed the printed circuit board passageway 66, through the first portion of the terminal passageway 74 and partially through the opening 70. The fingers 71 prevent the balls 54 from passing through the opening 70. Next, each spring 52 is dropped into each opening 72. Each spring 52 passes through the opening 72, through the second portion 76 of the terminal passageway 68, past the printed circuit board passageway 66, and into the first portion 74 of the terminal passageway 68 until the second end 58 of each spring 52 contacts a ball 54. Next the printed circuit board 36 is passed through the proximal end 60 of the terminal sleeve 42 and into the printed circuit board passageway 66. Although, the printed circuit board 36 is shown extending beyond the proximal end 60 of the terminal sleeve 32, the entire printed circuit board 36 could be positioned within the terminal sleeve 32. Once the printed circuit board 36 is properly aligned within the printed circuit board passageway 66, the springs 52 and balls 54 are securely positioned such that each spring 52 contacts a ball 54 and the printed circuit board 36 and a portion of each ball 54 extends beyond the outer surface 64 of the terminal sleeve 42. The springs 52 bias the balls 54 outwardly of the sleeve 42. In addition, the spring 52 provides an electrical connection between the balls 54 and the printed circuit board 36.

Next, the body 32 is assembled with the contact member 34. The distal end 62 of the terminal sleeve 42 is positioned next to the proximal end 81 of the contact sleeve 80, the outwardly protruding balls 54 of the body 32 are aligned with the gap 98, and the terminal sleeve 52 is slid into the contact passageway 100 until the distal end 62 of the terminal sleeve 42 is positioned proximate the distal end 83 of the contact member 34. The body 32 is rotated such that the balls 54 contact the detents 96 of each contact 78, and as rotation of the body 32 continues, the springs 52 compress and the balls become flush with the outer surface 64 of the terminal sleeve 42, allowing the balls 54 to be rotated beyond the detents 96. Once the balls 54 have been rotated past the detents 96, the springs 52 expand, the balls 54 move beyond the outer surface 64 and the engagement between the balls 54 and the detents 96 deter the body 32 from rotating into alignment with the gap 98 unless a user purposefully does so. With the hinge 30 assembled, each terminal 38 of the body 32 is engaged with the first surface 82 of the contact 78. The number of connections required between the electrical components in the base 22 of the electronic device 20 and the electrical components in the cover 24 of the electronic device 20 will determine the number of terminals 38 and contacts 78 required in the hinge 30.

The hinge 30 is then assembled with the remainder of the electronic device 20. The tails 92 of the contacts 78 are engaged with contact pads, for example, contact pads in the cover 24 of the electronic device 20 and the printed circuit board 36 along with the connector 40 is mounted to the base 22 of the electronic device. Electrical connection between the body 32 of the hinge 30 and components in the base 22 is accomplished through the connector 40. As the cover 24 of the electronic device is raised and lowered the contact member 34 rotates relative to the body 32. As the body 32 of the hinge 30 rotates, the ball 54 of each terminal remains electrically connected to a respective contact 78.

The hinge 30 provides several advantages over prior art hinges. One advantage provided by the hinge 30, is that the hinge 30 can be assembled apart from the remainder of the electronic device 28. Thus, assembly and testing of the hinge 30 is performed prior to assembly of the hinge 30 with the electronic device 20. This feature also allows the hinge 30 to be easily replaced in the event it becomes damaged. The hinge 30 also provides a sealed system, wherein movement of the hinge 30 is provided inside the hinge 30. As a result, the hinge 30, along with the electrical connections, is shielded from dust and debris which results in a more reliable hinge. The hinge 30 can be made in essentially any length desired and can accommodate any number of connections desired. If more connections are desired the hinge 30 is simply made longer by adding more contacts 78 and terminals 38. If fewer connections are desired, the hinge 30 is made shorter by removing contacts 78 and terminals 38. The hinge 30 can be easily manufactured. A minimal number of steps are required for the insert mold process used to form the contact sleeve 80 and formation of the body 32 is also accomplished with a minimum number of steps.

Attention is invited to the second embodiment of the hinge, shown in FIG. 8. The second embodiment of the hinge is identical to the first embodiment of the hinge 30 except as described herein, therefore, like reference numerals are used for like components. The second embodiment of the hinge includes a printed circuit board 202 and a plurality of terminals 38 as shown in FIG. 8. The printed circuit board 202 includes a first surface 206, a second surface 208, a proximal end 210 and a distal end 212. The terminals 38 extend perpendicularly from the first surface 206 and the second surface 208 of the printed circuit board 202. The terminals 38 extending from the first surface 206 of the printed circuit board 202 are offset from the terminals 38 extending from the second surface 208 of the printed circuit board 202. As such, each terminal 38 extending from the first surface 206 of the printed circuit board 202 is aligned with a space between the terminals 38 extending from the second surface 208 of the printed circuit board 202 and each terminal 38 extending from the second surface 208 of the printed circuit board 202 is aligned with a space between the terminals 38 extending from the first surface 206 of the printed circuit boar. Each terminal 38 includes a spring 52, having a first end 56 and a second end 58, and a ball 54. The first end 56 of each spring 52 is attached to the respective surface of the printed circuit board 202. A ball 54 is positioned on the second end 58 of each spring 52. A connector 222 also extends from the first surface 206 of the printed circuit board 202.

To assemble the body of the second embodiment of the hinge, the terminal sleeve 42 is positioned such that the openings 70 are directed downward. Next, each ball 54 is passed through an opening 72, through the second portion 76 of a terminal passageway 68, passed the printed circuit board passageway 66, into the first portion 74 of the terminal passageway 68, and partially through the opening 70. Next, each spring 52 is passed through an opening 70, through the second portion 76 of the terminal passageway 68, past the printed circuit board passageway 66, and into the first portion 76 of the terminal passageway 68. Next, the printed circuit board 202 is placed within the printed circuit board passageway 66. With the printed circuit board 202 in place, the terminal sleeve 42 is rotated without displacing the balls 54 and springs 52 within the first portions 74 of the terminal passageways 68. Next, additional springs 52 are placed within the second portions 76 of the terminal passageways 68 and then balls 54 are placed within the second portions 76 of the terminal passageways 68. While maintaining the openings 72 generally upward, the contact member 34 is aligned with the terminal sleeve 42, such that the gap 98 of the contact member 34 is aligned with one of the rows of balls 54. The terminal sleeve 42 is then slid into the contact member 34. Once all of the balls 54 are positioned within the contact member 34 the sleeve 42 and contact member 34 is rotated as the contacts 78 will prevent the balls 54 proximate the openings 70, 72 from falling out of the terminal sleeve 42. The spring 52 provides an electrical connection between the contacts 78, the balls 54, and the printed circuit board 202. Because the terminals 38 extend from the first surface 206 and the second surface 208 of the printed circuit board 202, adjacent terminals 38 will engage their respective contacts 78 at diametrically opposed points on the contacts 78.

The hinge in accordance with the second embodiment provides for an increased terminal pitch. Thus, more connections may be provided between the cover 24 and the base 22 of the electronic component 20 without increasing the length of the hinge.

Attention is now invited to the third embodiment of the hinge shown in FIGS. 9 and 10. The third embodiment of the hinge is similar to the first embodiment of the hinge except for the differences described herein. As shown in FIGS. 9 and 10, the hinge includes a first printed circuit board 302 and a second printed circuit board 304. Each printed circuit board is generally rectangular and includes a proximal end 306, 308, a distal end 310, 312, a first surface 314, 316, and a second surface 318, 320. Springs 322 are mounted between the first surfaces 314, 316 of the first and second printed circuit boards 302, 304 and allow the printed circuit boards 302, 304 to flex toward and away from each other. A row of contact pads 322 is provided on the second surface 318 of the first printed circuit board 302 and a row of contact pads 324 is provided on the second surface 320 of the second printed circuit board 304. The contact pads 322 are offset from the contact pads 324. Thus, the contact pads 322 are aligned with spaces between the contact pads 324 and the contact pads 324 are aligned with the spaces between the contact pads 322. A terminal 326 (only two of which are shown in FIG. 9) is provided on each contact pad 322. A terminal 328 (only two of which are shown in FIG. 10) is provided on each contact pad 324. The terminals 326, 328 are generally spherically-shaped.

The terminal sleeve of the third embodiment is generally tubularly-shaped and includes two diametrically opposed rows of openings. The circumference of each opening is dimensioned such that a portion of each ball extends through each opening.

To assemble the third embodiment of the hinge, the springs 322 are pre-loaded such that the first 302 and second printed circuit board 304 are moved toward one another. The printed first and second circuit boards 302, 304, along with the terminals 326, 328 mounted thereon, are placed within the tubularly-shaped terminal sleeve such that the terminals 326, 328 are aligned with the rows of openings. The pre-load on the springs 322 is then released such that the printed circuit boards 302, 304 are securely positioned within the terminal sleeve. The remainder of the hinge assembly is the same as the assembly of the first and second embodiments of the hinge.

While preferred embodiments of the present invention are shown and described, it is envisioned that those skilled in the art may devise various modifications of the present invention without departing from the spirit and scope of the appended claims.

What is claimed is:

1. A hinge for an electronic device comprising:

a body including a printed circuit board and a terminal extending from the printed circuit board;

a contact member including a conductive contact and a contact sleeve, the contact member defining a contact passageway, wherein the terminal and at least a portion of the printed circuit board are positioned within the contact passageway, the terminal is electrically coupled to the contact, the contact is capable of movement relative to the terminal, and electrical contact is maintained between the contact and the terminal throughout the movement of the contact relative to the terminal.

2. A hinge as defined in claim 1, wherein the terminal is formed from a spring having two ends and a ball positioned on one end of the spring and the opposite end of the spring is attached to the printed circuit board.

3. A hinge as defined in claim 1, further comprising a terminal sleeve and wherein at least a portion of the printed circuit board is positioned within the sleeve and wherein a portion of the terminal extends through the sleeve.

4. A hinge as defined in claim 3, wherein the terminal sleeve includes a printed circuit board passageway and a terminal passageway, the terminal passageway including two diametrically opposed openings, and wherein the terminal passageway is in communication with the printed circuit board passageway.

5. A hinge as defined in claim 4, wherein the terminal is formed from a spring having two ends and a ball positioned on one end of the spring and wherein the effective diameter of one of the openings is smaller than the diameter of the ball.

6. A hinge as defined in claim 2, further comprising a terminal sleeve and wherein at least a portion of the printed circuit board is positioned within the terminal sleeve and wherein a portion of the ball extends through the terminal sleeve.

7. A hinge as defined in claim 1, wherein the contact sleeve covers a portion of the conductive contact.

8. A hinge as defined in claim 7, wherein the contact includes a generally circular portion and a tail portion and wherein said contact sleeve covers the generally circular portion.

9. A hinge as defined in claim 1, further comprising a connector electrically coupled to the printed circuit board.

10. A hinge as defined in claim 1, wherein the body includes a plurality of terminals extending from one side of the printed circuit board.

11. A hinge as defined in claim 1, wherein the body includes a plurality of terminals and wherein the plurality of terminals extend from opposite sides of the printed circuit board.

12. A hinge as defined in claim 1, wherein the contact member includes a plurality of contacts and wherein each terminal is electrically connected to one of the plurality of contacts.

13. A hinge as defined in claim 1, wherein the contact sleeve is shielded.

14. An electronic device comprising: a base portion including electronic components, a cover including electronic components; a hinge electrically connecting the electronic components of the base portion to the electronic components of the cover, the hinge including:

a body including a printed circuit board and a terminal extending from the printed circuit board, a contact member including a conductive contact, the conductive contact defining a contact passageway, wherein the terminal is positioned within the contact passageway and electrically coupled to the conductive contact, the contact is capable of movement relative to the terminal, and electrical contact is maintained between the contact and the terminal throughout the movement of the contact relative to the terminal.

* * * * *